US012024807B2

(12) United States Patent
Bossi et al.

(10) Patent No.: US 12,024,807 B2
(45) Date of Patent: Jul. 2, 2024

(54) ROTATABLE DRUM LAUNDRY MACHINE AND CONTROL METHOD THEREOF

(71) Applicant: Electrolux Appliances Aktiebolag, Stockholm (SE)

(72) Inventors: Marco Bossi, Porcia (IT); Daniele De Vito, Porcia (IT); Andrea Calanca, Curtatone (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 497 days.

(21) Appl. No.: 17/299,040

(22) PCT Filed: Dec. 6, 2018

(86) PCT No.: PCT/EP2018/083878
§ 371 (c)(1),
(2) Date: Jun. 2, 2021

(87) PCT Pub. No.: WO2020/114602
PCT Pub. Date: Jun. 11, 2020

(65) Prior Publication Data

US 2022/0025567 A1 Jan. 27, 2022

(51) Int. Cl.
*D06F 33/48* (2020.01)
*D06F 23/02* (2006.01)
(Continued)

(52) U.S. Cl.
CPC ..... *D06F 33/48* (2020.02); *D06F 23/025* (2013.01); *D06F 33/40* (2020.02); *D06F 34/16* (2020.02);
(Continued)

(58) Field of Classification Search
CPC ..... D06F 33/48; D06F 33/40; D06F 34/16; D06F 23/025; D06F 37/304; D06F 2105/48; D06F 2103/26
(Continued)

(56) References Cited

U.S. PATENT DOCUMENTS

2005/0204482 A1 9/2005 Murray et al.
2011/0119839 A1* 5/2011 Lilie ..... D06F 37/206 68/12.01
2017/0145621 A1 5/2017 Sumer et al.

FOREIGN PATENT DOCUMENTS

DE 19738211 A1 3/1999
DE 19738310 A1 3/1999
(Continued)

OTHER PUBLICATIONS

DE19804080A1—Machine translation (Year: 1999).*
(Continued)

*Primary Examiner* — Tinsae B Ayalew
(74) *Attorney, Agent, or Firm* — Bradley Arant Boult Cummings LLP

(57) ABSTRACT

A method for redistributing a laundry load in a drum of a washing machine in order to reduce the unbalance generated to the nonuniform distribution of said laundry load in said drum. The method comprises: generating a sinusoidal motor speed profile (RS(t)), controlling the electric motor based on the sinusoidal motor speed profile (RS(t)), estimating unbalance value indicative of the unbalance of load in the laundry drum, estimating an inertia value indicative of the inertia of the load in the laundry drum, varying the amplitude of the sinusoidal speed profile (RS(t)) based on estimated unbalance value and inertia value, and controlling said electric motor based on modified sinusoidal motor speed profile.

20 Claims, 3 Drawing Sheets

(51) Int. Cl.

| | |
|---|---|
| ***D06F 33/40*** | (2020.01) |
| ***D06F 34/16*** | (2020.01) |
| ***D06F 37/30*** | (2020.01) |
| *D06F 103/26* | (2020.01) |
| *D06F 105/48* | (2020.01) |

(52) U.S. Cl.
CPC ..... *D06F 37/304* (2013.01); *D06F 2103/26* (2020.02); *D06F 2105/48* (2020.02)

(58) Field of Classification Search
USPC ..... 68/12.01
See application file for complete search history.

(56) References Cited

FOREIGN PATENT DOCUMENTS

| | | | |
|---|---|---|---|
| DE | 19804080 | B1 | 8/1999 |
| EP | 2463433 | A2 | 6/2012 |

OTHER PUBLICATIONS

International Search Report and Written Opinion for International Application No. PCT/EP2018/083878, dated Jul. 11, 2019, 10 pages.

* cited by examiner

ROTATABLE DRUM LAUNDRY MACHINE AND CONTROL METHOD THEREOF

This application is a U.S. National Phase application of PCT International Application No. PCT/EP2018/083878, filed Dec. 6, 2018, which is incorporated by reference herein.

TECHNICAL FIELD

The present invention relates to a rotatable drum laundry machine and a control method thereof, and, more in particular to a washing machine that is configured to redistribute laundry-load in the rotatable-drum by using a sinusoidal motor speed profiled which is varied based on the unbalance and inertia, and a control method thereof.

BACKGROUND

As is known, a washing machine generally includes a water tub to receive water (wash water or rinse water), a cylindrical drum rotatably mounted in the water tub to receive laundry, and an electric motor to generate a drive force necessary to rotate the drum, that washes the laundry by lifting and dropping the laundry in the drum along the inner wall of the drum during the rotation of the drum.

The washing machine performs laundry cleaning through a washing cycle for removing contaminants from laundry with water containing detergent dissolved therein, a rinsing cycle for removing detergent from the laundry with water, and a spin cycle to spin-drying the laundry at a high speed.

During the spin cycle, if the drum is rotated at a high speed while laundry is not uniformly distributed along the inner wall of the drum, i.e., the laundry is unbalanced, an eccentric force is applied to a rotary shaft of the drum, with the result that large vibration may occur.

Therefore, if laundry load is not evenly distributed, a significant imbalance may cause a vibration while drum is spinning, that, in turn, may cause the rotating drum to strike chassis, resulting in damage to the machine.

In order to prevent the above-disclosed problem, washing machines perform unbalance control methods to estimate the laundry unbalance in the drum and perform a laundry redistribution based on the estimated unbalance.

Generally, unbalance control methods compare the estimated unbalance with a prefixed unbalance threshold and perform a laundry redistribution step based on result of comparison. More specifically the imbalance threshold is fixed to a high value, i.e. greater than about 700 g, in order to limit the number of laundry redistribution steps and reduce the time consumed to perform the redistribution of the laundry.

It is also known that for performing a redistribution of the laundry, washing machines work such that first the laundry is spun at about 45 rpm, and after this the rotational speed is slowly increased to a speed value at which redistribution is no longer to be expected. The unbalance is generally measured at this rotational speed.

If the unbalance exceeds the unbalance threshold, the method sharply reduces the rotational speed in order that the laundry redistribution is possible again. Such redistribution method is disclosed, for example, in DE 197 38 211 A1 and DE 197 38 310 A1. However, solutions disclosed in DE 197 38 211 A1 and DE 197 38 310 A1 have the technical problem that when the drum rotational speed is reduced in some conditions, laundry may move uncontrolledly causing an increasing of the unbalance.

DE 1 980 408 0 B4 deals with this problem and provides a control method increasing the speed of the drum based on a prefixed speed profile to cause the laundry to be attached to the inner wall of the drum, and measures the imbalance of the laundry when the laundry is attached to the inner wall.

If the measured unbalance is greater than a prefixed imbalance threshold, the method regulates the motor speed in order to cause the lower amplitude of the motor speed oscillation caused by the load, to be lower than a fixed redistribution speed. When the motor speed oscillation is lower than the fixed redistribution speed, part of the laundry is temporarily detached from the inner wall of drum and redistributed inside the drum. Since the laundry imbalance is in the highest position at the moment of the minimum rotational speed, the laundry part which is responsible for the imbalance and is disposed on the side of the imbalance, actually drops.

The laundry redistribution performed by this control method is conveniently selective because it detaches part of laundry, i.e. the part of laundry that is not evenly distributed in the drum. Therefore, the control method redistributes with relative precision part of laundry causing the imbalance.

However, operations performed by the method are quite complex to be performed because the algorithm to be performed on the motor control loop needs to be able to stiffen or relax the motor control speed to change unbalance-based oscillation.

Moreover, the method is based on a fixed redistribution speed, which is set according to a laundry load having a prefixed weight. However if redistribution speed is set too high, lighter washing machine models could develop unwanted effects, like walking or bumping, even at low speeds; on the other hand, if redistribution speed is set too low, redistribution can be exceeding the wanted effect, resulting in a completely new load situation every time the redistribution method is performed.

Furthermore, the applicant has found that the method is inefficient in performing the redistribution of the laundry-load to reduce the unbalance generated to the nonuniform load distribution because, during the cycle, the actual redistribution speed changes in response to the change of position of the unbalanced part of laundry in the drum.

SUMMARY

Aim of the present invention is to provide a control method, which is able to automatically redistribute the laundry in the drum based on the actual amount of the laundry loaded in the drum.

In compliance with the above aims, according to the present invention there is provided a method for redistributing a laundry load in a drum of a washing machine in order to reduce the unbalance generated to the nonuniform distribution of said laundry load in said drum, wherein said washing machine comprises: a casing, a laundry drum mounted inside the casing to rotate about a rotation axis, and an electric motor designed to rotate said laundry drum about said rotation axis, the method being characterized in comprising: generating a sinusoidal motor speed profile, controlling said electric motor based on said sinusoidal motor speed profile, estimating unbalance value indicative of the unbalance of said load in the laundry drum, estimating an inertia value indicative of the inertia of the load in the laundry drum, varying the amplitude of said sinusoidal speed profile based on said estimated unbalance value and inertia value, controlling said electric motor based on said modified sinusoidal motor speed profile.

Preferably, said rotation axis is horizontal or inclined with respect to base of the washing machine.

Preferably, the method further comprises determining a motor speed value indicative of the speed of said electric motor, estimating a settling speed based on said inertia value, interrupting said generation of sinusoidal speed profile and increasing the motor speed to a prefixed high speed of a spin cycle if: said estimated unbalance value is lower than an unbalance threshold, and—said motor speed value is greater than said settling speed.

Preferably, the method further comprises the steps of determining a motor speed value indicative of the speed of said electric motor, estimating a settling speed based on said inertia value, interrupting said generation of sinusoidal speed profile and increasing the motor speed to a prefixed high speed of a spin cycle if: said estimated unbalance value is lower than an unbalance threshold, and said motor speed value is greater than said settling speed, and said minimum speed value of said said sinusoidal motor speed profile is greater than said settling speed.

Preferably, the method further comprises the steps of continuing the generation of said sinusoidal speed profile and varying the amplitude of said sinusoidal speed profile, if the estimated unbalance is greater than said unbalance threshold.

Preferably, the method further comprises the steps of determining a motor speed value indicative of the speed of said electric motor, estimating a settling speed based on said inertia value, continuing the generation of said sinusoidal speed profile and varying the amplitude of said sinusoidal speed profile if: said estimated unbalance is lower than said unbalance threshold, and said motor speed value is lower than said settling speed and/or the minimum speed value of said sinusoidal motor speed profile is lower than said settling speed.

Preferably, the method further comprises the steps of calculating a maximum speed value and a minimum speed value of said sinusoidal speed profile based on said unbalance value, said inertia value and a prefixed unbalance threshold, and wherein the amplitude of said sinusoidal speed profile is varied on the basis of said calculated maximum speed value and said calculated minimum speed value.

Preferably, said maximum speed value and said minimum speed value of said sinusoidal motor speed profile are repeatedly calculated based on the difference between said unbalance and said unbalance threshold and on said inertia.

Preferably, the method further comprises the steps of repeatedly performing during prefixed intervals: estimating said unbalance value, estimating said inertia value, estimating said settling speed, varying the amplitude of said sinusoidal speed profile based on said estimated unbalance values and inertia values, and controlling said electric motor based on said modified sinusoidal motor speed profile.

Preferably the unbalance value and inertia value are estimated on the basis of said speed value and said torque value.

According to the present invention there is also provided a washing machine comprising: a casing, a laundry drum mounted inside the casing to rotate about a rotation axis, and an electric motor designed to rotate said laundry drum about said rotation axis, said washing machine being characterized in comprising an electronic control system configured to: generating a sinusoidal motor speed profile, controlling said electric motor based on said sinusoidal motor speed profile, estimating an unbalance value indicative of the unbalance of said load in the laundry drum, estimating an inertia value indicative of the inertia of the load in the laundry drum, varying the amplitude of said sinusoidal speed profile based on said estimated unbalance value and said inertia value, controlling said electric motor based on said modified sinusoidal motor speed profile.

Preferably, said rotation axis is horizontal or inclined with respect to base of the washing machine.

Preferably, said electronic control system is further configured to: determine a motor speed value indicative of the speed of said electric motor, estimate a settling speed based on said inertia value, interrupt said generation of sinusoidal speed profile, and increase the motor speed to a prefixed high speed of a spin cycle, if: the estimated unbalance value is lower than an unbalance threshold, said motor speed value is greater than said settling speed.

Preferably, said electronic control system is further configured to: determine a motor speed value indicative of the speed of said electric motor, estimate a settling speed based on said inertia value, interrupt said generation of sinusoidal speed profile, and increase the motor speed to a prefixed high speed of a spin cycle, if: the estimated unbalance value is lower than an unbalance threshold, said motor speed value is greater than said settling speed, and the minimum speed value of said said sinusoidal motor speed profile is greater than said settling speed.

Preferably, said electronic control system is further configured to continue the generation of sinusoidal speed profile and varies the amplitude of said sinusoidal speed profile, if the estimated unbalance is greater than said unbalance threshold.

Preferably, said electronic control system is further configured to continue the generation of sinusoidal speed profile and varies the amplitude of said sinusoidal speed profile, if the estimated unbalance is lower than said unbalance threshold and said motor speed value is lower than said settling speed and/or a minimum speed value of said sinusoidal motor speed profile is lower than said settling speed.

Preferably, said electronic control system is further configured to calculate a maximum speed value and a minimum speed value based on said unbalance value, said inertia value and a prefixed unbalance threshold and vary the amplitude of said sinusoidal speed profile on the basis of said calculated maximum speed value and said calculated minimum speed value.

Preferably, said electronic control system is further configured to repeatedly performs during prefixed intervals: estimating said unbalance values, estimating said inertia values, estimating said settling speeds, varying the amplitude of said sinusoidal speed profile based on said estimated unbalance values and inertia values, and controlling said electric motor based on said modified sinusoidal motor speed profile.

Preferably, said electronic control system is further configured to estimate said unbalance value and said inertia value are estimated on the basis of said speed value and said torque value.

BRIEF DESCRIPTION OF THE DRAWINGS

A non-limiting embodiment of the present invention will now be described, by way of example, with reference to the accompanying drawings, in which.

DETAILED DESCRIPTION

Figure 1:
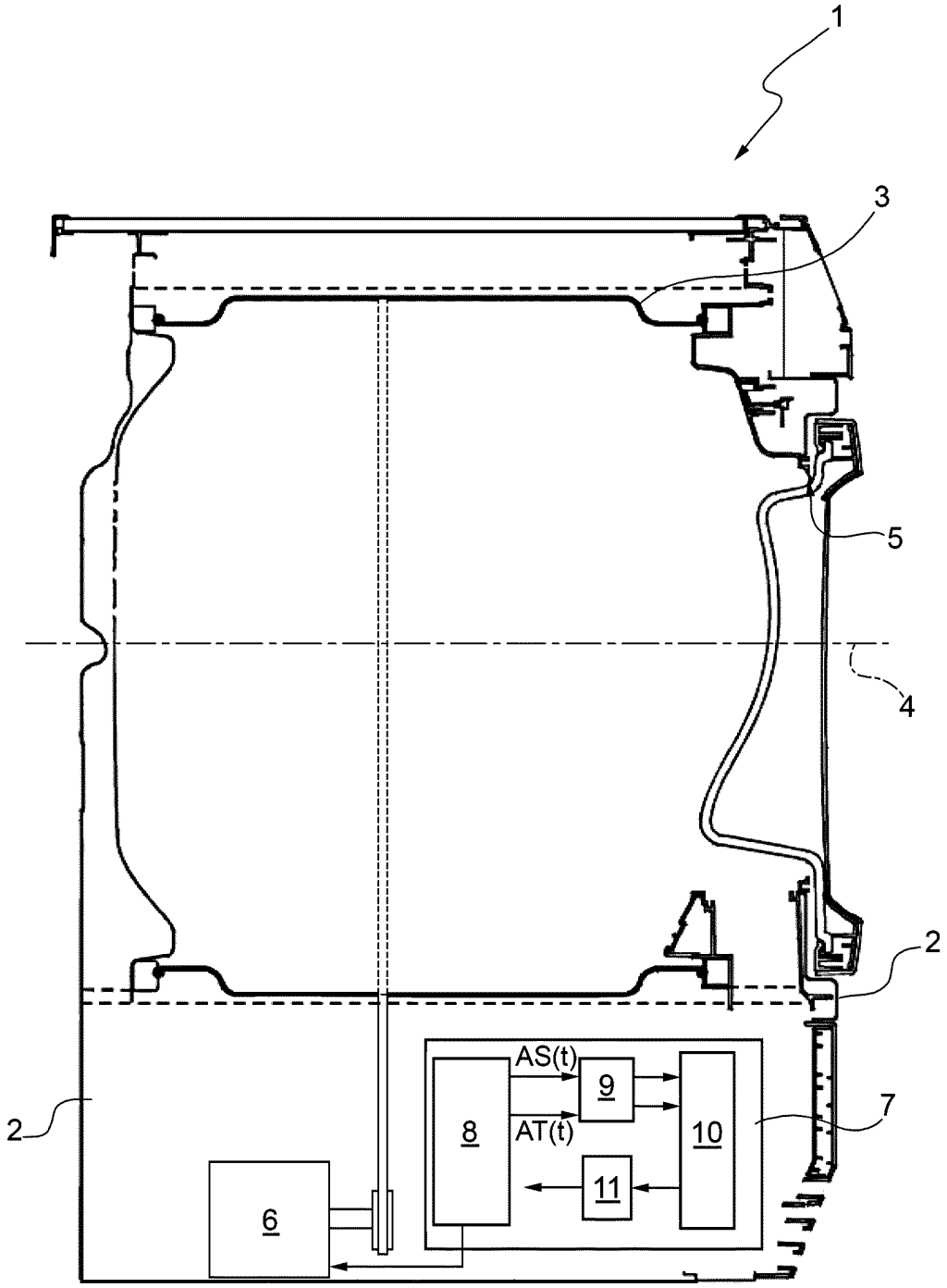
FIG. 1 shows schematically a rotatable-drum laundry machine comprising a electronic control system configured to perform the control method in accordance with the teachings of the present invention.

Number 1 in FIG. 1 schematically indicates as a whole a laundry appliance, such as a rotatable-drum laundry washing machine or a laundry drying machine, which may comprise: a casing/cabinet 2, a rotatable laundry drum 3 mounted inside casing 2 to rotate freely about an axis of rotation 4 which may be horizontal (or inclined or vertical), and directly facing a laundry loading/unloading opening 5 formed in a wall of casing 2, and an electric motor 6 which is designed to rotate the drum 3 about the axis of rotation 4.

The rotatable-drum laundry washing machine 1 further comprises an electronic control system 7, which is configured to perform a control method, hereinafter disclosed in detail, to drive/control the electric motor 6 in order to redistribute the laundry load inside the drum 3 so as to reduce the unbalance.

Preferably, the control method may be performed by the electronic control system 7 before a spin cycle or during a spin cycle. Preferably, the control method may be performed at the start of a spin cycle, i.e. when the spin cycle is initiated.

According to an exemplary embodiment illustrated in FIG. 1, the electronic control system 7 may comprise: a motor driving unit 8, an estimator unit 9, a profile controller 10 and a profile generator 11.

The profile generator 11 may be configured to output an electrical profile signal indicative of, corresponding to, a motor speed profile.

Figure 2:
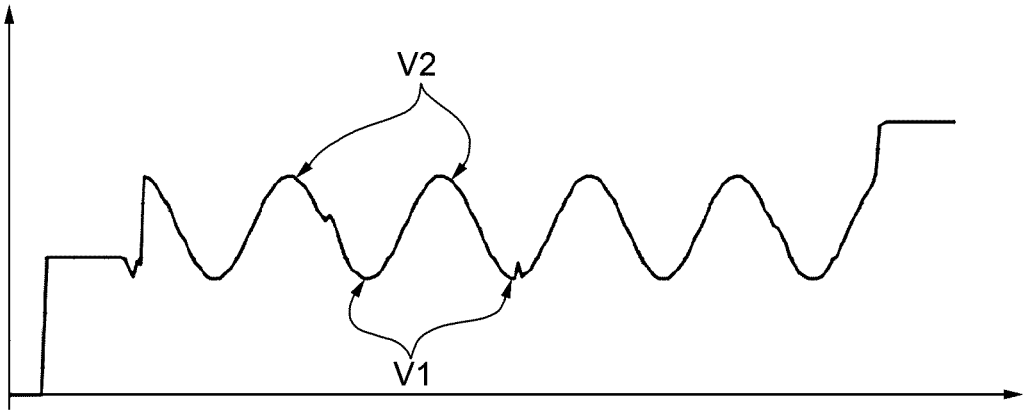
FIG. 2 is a chart schematically illustrating an example of the sinusoidal motor speed profile.

Preferably, the motor speed profile may correspond about to a sinusoidal speed profile. According to an exemplary embodiment illustrated in FIG. 2, the sinusoidal speed profile may be set in order to have an amplitude, which varies between a minimum speed value indicated with V1, and a maximum speed value indicated with V2.

The motor driving unit 8 may be configured to receive in input the electrical profile signal provided by the profile generator 11 and controls the electric motor 6 in order to regulate/vary the motor speed according to the received motor speed profile. More specifically, the motor driving unit 8 may be configured to control the electric motor 6 in order to regulate/vary the motor speed according to the sinusoidal reference profile.

Figure 3:
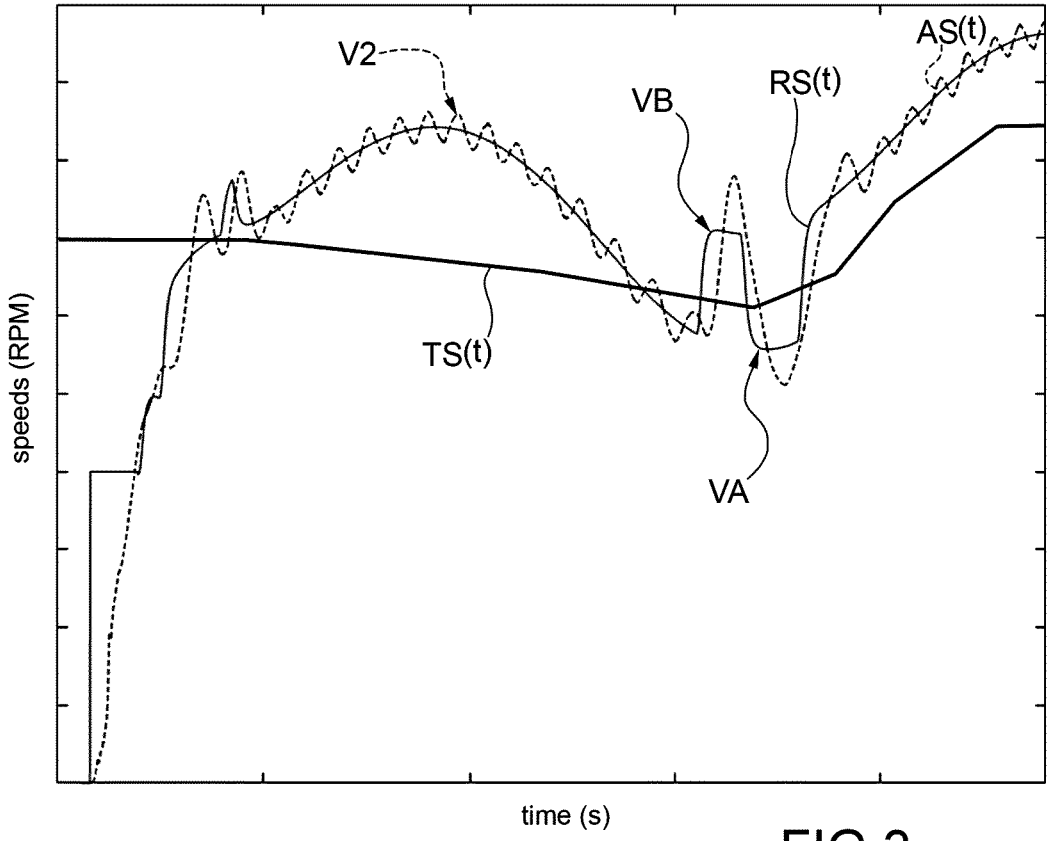
FIG. 3 is a chart illustrating the settling speed, the actual motor speed, and the modified motor speed profile.

As illustrated in the example of FIG. 3, the motor driving unit 8 uses the profile signal as a reference speed RS(t), and provides the electrical profile signal to the electric motor 6 so that the actual motor speed AS(t) of the electric motor 6 follows the reference speed RS(t). It is understood that actual motor speed AS(t) is affected by oscillation/fluctuations caused by the unbalance.

According to an exemplary embodiment, the motor driving unit 8 may also be configured to output electrical signals indicative of the actual motor speed AS(t) and the actual motor torque AT(t).

The motor driving unit 8 may further be configured to continuously/repeatedly estimate or determine the actual motor speed AS(t) and actual motor torque AT(t). It is understood that actual motor speed AS(t) and actual motor torque AT(t) may be estimated or determined by means of known method/system. For example, the actual motor speed AS(t) and the actual motor torque AT(t) may be estimated by the motor driving unit 8 based on the electric signals (current/s, voltage/s) of the electric motor 6.

The estimator unit 9 may be configured to receive from the motor driving unit 8 the electrical signals indicative of the actual motor speed AS(t) and the actual motor torque AT(t).

The estimator unit 9 may be further configured to estimate the unbalance value indicative of the unbalance of the laundry load in the drum 3. Preferably, unbalance of the laundry load in the drum 3 may be estimated based on the estimated actual motor speed AS(t) and the estimated actual motor torque AT(t).

The estimator unit 9 may be further configured to estimate the inertia value indicative of the inertia of the laundry loaded in the drum 3. Preferably, the inertia value may be estimated based on the estimated actual motor speed AS(t) and estimated actual motor torque AT(t).

The estimator unit 9 may be further configured to estimate a settling speed TS based on the estimated inertia.

It is understood that the settling speed TS is the minimum rotation speed wherein the laundry load is completely attached on the inner wall of the drum 3. The Applicant has found that variation in amount of loads, causes a variation of settling speed. Small loads inside the drum leads to a small settling speed TS, and vice versa, higher loads leads to a high settling speed TS. Therefore, to properly redistribute the laundry, it is important to execute a redistribution which runs below (or slightly below) the real settling speed which depends in turn on the amount of loads.

A redistribution performed in that way will result in automatically shapen speeds to redistribute any load without walking issues, and guarantee that once redistribution has ended, the laundry load is properly settled. Therefore, with loads of different weight, different real settling radius of the laundry can be inferred.

In this respect, the estimator unit 9 conveniently determines the settling speed TS according to the estimated inertia, which is in turn associated with the load amount.

The estimator unit 9 may further be configured to determine a minimum value of motor speed VA and a maximum value of motor speed VB based on the unbalance value, the inertia value an prefixed unbalance thresholds and at the same time vary/regulate the amplitude of the sinusoidal speed profile generated by the profile generator 9 based on the calculated minimum value VA and a maximum value VB of speed.

Furthermore, as will be disclosed hereinafter in detail, the electronic control system 7 operates so as to estimate, time after time, i.e. at prefixed instants/intervals Δti, in a continuously manner, the unbalance, the inertia and the settling speed of the laundry load preferably based on the estimated motor speed AS(t) and motor torque AT(t), so that when the unbalance is greater than the prefixed unbalance threshold, the minimum value VA is reduced in a value lower than the re-calculated settling speed. That conveniently allows the electronic control system 7 to selectively redistribute only the part of the laundry that has caused the unbalance in the drum, i.e. the part which is generally placed near the centre of the drum 3 compared to the rest of the laundry loaded in the drum 3.

On the contrary, when the unbalance is lower than the prefixed unbalance threshold and the laundry load is correctly attached to the inner wall of the drum 3, the electronic control system 7 determines a balanced condition and may start the spin cycle.

Preferably, the minimum value of motor speed VA and the maximum value of motor speed VB may be repeatedly determined, i.e. at any interval Δti, in function of difference between the estimated imbalance value and the prefixed maximum imbalance threshold.

For example, the estimator unit 9 may be configured to determine at any interval Δti, an error value by performing the difference between the estimated imbalance value and the prefixed maximum imbalance threshold, and calculate the minimum value of motor speed VA and the maximum value of motor speed VB in order to reduce the error value. It is understood that the estimator unit 9 may calculate the minimum value of motor speed VA and the maximum value of motor speed VB by performing, for example a proportional, integral, and derivative method so as to minimize the error value.

The estimator unit 9 may be configured to provide to the profile controller 10 the calculated minimum value of speed VA and calculated maximum value of speed VB.

The profile controller 10 is configured to continuously and repeatedly vary/regulate, i.e. at any interval Δti, the amplitude of the speed profile RS generated by the profile generator 9 based on the calculated minimum value VA and a maximum value VB of speed.

Preferably, the profile controller 10 is configured to vary/regulate the minimum value V1 and a maximum value V2 of the amplitude of speed profile RS(t) (reference motor speed) generated by the profile generator 11 based on the estimated minimum value VA and respectively the maximum value VB of speed.

As above disclosed, the estimator unit 9 is therefore designed to repeatedly and continuously determine, i.e. at any interval Δti, the inertia value, the unbalance value and the settling speed, based on the determined estimated motor speeds AS(t) and motor torques AT(t), and based on such values, modify the minimum and maximum values VA, VB of the speed profile RS(t).

Figure 4:
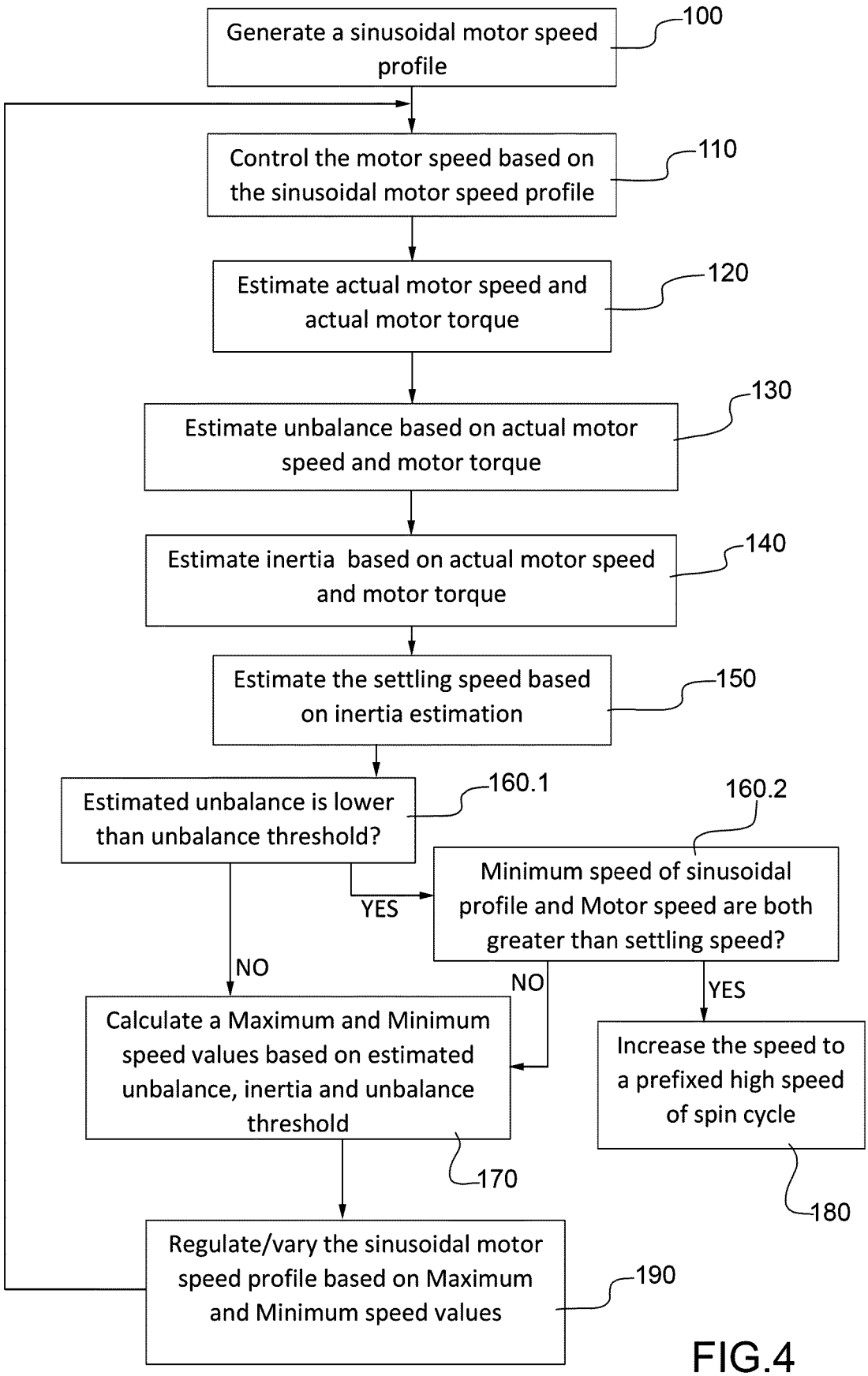
FIG. 4 is a flow chart of the operations performed by the control method in accordance with the teachings of the present invention.

FIG. 4 shows a flow chart of the operations of the control method performed by electronic control system 7 according to the present invention. It is understood that the control method may be preferably performed when the spin cycle is initiated.

Referring of FIG. 4, the method starts the spin cycle by controlling the electric motor 6 in order to rotate the drum 3 so as to move the laundry inside the drum 3. It is understood that at the beginning, the method runs over the speed to obtain a constantly (but slowly) varying speed between the settling speed TS(t) and the redistribution speed (not illustrated) so that the laundry is attached to the inner wall of the drum 3.

The method generates by means of the profile generator 11, the motor speed profile (block 100) which, at the initial step (on left in FIG. 3), may correspond to a memorized profile having the pre-set minimum value V1 and respectively the pre-set maximum value V2 of speed.

The method controls the electric motor 6 by means of the motor driving unit 8 in order to regulate/vary the motor speed according to the received motor speed profile RS (t). More specifically the electric motor 6 is controlled in order to regulate/vary the motor speed according to the sinusoidal reference profile between the minimum V1 and maximum speed V2 (block 110).

At any interval Δti, the method estimates the actual motor speed AS(t) and the actual motor torque AT(t) (block 120).

The method repeatedly and continuously estimates an unbalance value indicative of the amount of laundry loaded in the drum 3, preferably, based on the estimated actual motor speed AS(t) and the estimated actual motor torque AT(t) (block 130).

The method repeatedly and continuously estimates the inertia value indicative of the inertia of the laundry loaded in the drum 3, preferably based on the estimated actual motor speed AS(t) and the estimated actual motor torque AT(t) (block 140).

The method repeatedly and continuously estimates the settling speed TS(t) of the load, based on the inertia estimation and so, based on the estimated amount of laundry load (block 150).

The method compares the estimated unbalance with the prefixed unbalance threshold (block 160.1).

If the estimated unbalance is not lower than the prefixed unbalance threshold (output NO block 160.1), the method calculates the minimum value of motor speed VA and the maximum value of motor speed VB based on the estimated unbalance, inertia and unbalance threshold (block 170).

If the estimated unbalance is lower than the prefixed unbalance threshold (YES output in block 160.1), the method compares the actual motor speed AS(t) and the minimum speed with the settling speed TS(t) (block 160.2).

If both actual motor speed AS(t) and minimum speed V1 are greater than the settling speed TS(t) (output YES block 160.2), the control method increases the drum speed to a prefixed high speed of the spin cycle (block 180).

In detail in this step if the the estimated unbalance value is lower than an unbalance threshold, the motor speed value AS(t) is greater than said settling speed TS(t), and the minimum speed value V1 of said said sinusoidal motor speed profile RS is greater than said settling speed TS(t) the method interrupts the generation of sinusoidal speed profile, and increases the motor speed to a prefixed high speed of a spin cycle.

If the actual motor speed AS(t) and/or the minimum speed V1 are lower than the settling speed TS(t) (output NO block 160.2) the method continuous to vary sinusoidal motor speed profile RS. Preferably, if the actual motor speed AS(t) and/or the minimum speed V1 are lower than the settling speed TS(t) (output NO block 160.2) the method calculates the minimum value of motor speed VA and the maximum value of motor speed VB based on the estimated unbalance, inertia and unbalance threshold (block 170).

However, it is understood that according to an alternative embodiment of the present invention (not illustrated), the method may interrupt the generation of sinusoidal speed profile and increase the motor speed to a prefixed high speed of a spin cycle, if the estimated unbalance is lower than the prefixed unbalance threshold and the actual motor speed value AS(t) is greater than the settling speed TS(t).

Preferably, for example, the method may determine the minimum value of motor speed VA and the maximum value of motor speed VB based on the difference between the estimated imbalance and a prefixed maximum imbalance threshold. Preferably the method may determine an error value by performing the difference between the estimated imbalance and the prefixed maximum imbalance threshold and regulate/vary the minimum value of motor speed VA and the maximum value of motor speed VB in order to reduce the error value.

At any interval Δti, the method varies/regulates the amplitude of the motor speed profile based on the estimated minimum value VA and a maximum value VB of speed (block 190). Preferably, the method varies/regulates the minimum value V1 and a maximum value V2 of the amplitude of speed profile RS generated by the profile generator 11 based on the estimated minimum value VA and respectively the maximum value VB of speed.

The method controls the motor speed based on the modified sinusoidal speed profile RS (block 110).

The above operations performed by blocks 110-160.1, and blocks 160.2-190 are continuously and repeatedly implemented at any interval Δti, until the conditions of block 160.2 are meet. In detail, the method is configured to repeatedly performs, at prefixed intervals Δti, the following steps: estimating the unbalance, the inertia and the settling speed so as to vary the reference speed RS followed by the electric motor 6. In other words, the change of the reference speed RS is repeatedly performed in continuously manner by the control method based on the unbalance, inertia and the settling speed estimated at prefixed intervals Δti.

Thus the control method is conveniently designed to control in continuative manner the unbalance, the inertia and settling speed, and is configured to vary/change the amplitude of the sinusoidal, i.e. the minimum and maximum values VA, VB of speed so as to reach a condition wherein the minimum speed of the sinusoidal reference speed RS and actual motor speed are both greater than the settling speed.

The control method implemented by the electronic control system advantageously works to be a completely automatic procedure for redistribution, adapting itself to the amount of load inside the drum. More specifically the method redistributes the correct amount of laundry, according to actual load conditions, i.e. by taking into account the unbalance and laundry amount.

It has thus been shown that the present invention allows all the set objects to be achieved.

Clearly, changes and variations may be made to the inverter-based apparatus and to the controlling method without, however, departing from the scope of the present invention.

The invention claimed is:

1. A method for operating a washing machine comprising a casing, a laundry drum mounted inside the casing to rotate about a rotation axis, and an electric motor configured to rotate the laundry drum about the rotation axis, the method comprising:

generating a sinusoidal motor speed profile (RS(t));

controlling the electric motor based on the sinusoidal motor speed profile (RS);

estimating an unbalance value indicative of an unbalance of a load in the laundry drum;

estimating an inertia value indicative of an inertia of the load in the laundry drum, generating a modified sinusoidal motor speed profile by varying an amplitude of the sinusoidal motor speed profile based on the estimated unbalance value and the inertia value, controlling the electric motor based on the modified sinusoidal motor speed profile to thereby redistribute the load in the laundry drum to reduce the unbalance of the load in the laundry drum;

determining a motor speed value (AS(t)) indicative of a motor speed of the electric motor;

estimating a settling speed (TS(t)) based on the inertia value; and interrupting the generation of sinusoidal motor speed profile and increasing the motor speed to a prefixed high speed of a spin cycle upon determining that:

the estimated unbalance value is lower than a predetermined unbalance threshold, and the motor speed value (AS(t)) is greater than the settling speed (TS(t)).

2. The method according to claim 1, wherein the step of interrupting the generation of sinusoidal motor speed profile and increasing the motor speed to the prefixed high speed of the spin cycle occurs upon further determining that:

a minimum speed value (V1) of the sinusoidal motor speed profile (RS(t)) is greater than the settling speed (TS(t)).

3. The method according to claim 1, further comprising, subsequent to controlling the electric motor based on the modified sinusoidal motor speed profile to thereby redistribute the load in the laundry drum to reduce the unbalance of the load in the laundry drum, and upon determining that the estimated unbalance is greater than the predetermined unbalance threshold:

generating the sinusoidal motor speed profile (RS(t)) a subsequent time; and varying the amplitude of the sinusoidal motor speed profile (RS(t)) a subsequent time.

4. The method according to claim 1, further comprising:

calculating a maximum speed value (VB) and a minimum speed value (VA) of the sinusoidal motor speed profile based on the unbalance value, the inertia value and the predetermined unbalance threshold; and varying the amplitude of the sinusoidal motor speed profile (RS) is further based on the calculated maximum speed value (VB) and the calculated minimum speed value (VA).

5. The method according to claim 4, wherein the maximum speed value (VB) and the minimum speed value (VA) of the sinusoidal motor speed profile (RS(t)) are repeatedly calculated based on a difference between the unbalance and the predetermined unbalance threshold and on the inertia.

6. The method according to claim 1, further comprising of repeatedly performing during prefixed intervals (Δti):

estimating the unbalance value;

estimating the inertia value;

estimating the settling speed (TS(t));

varying the amplitude of the sinusoidal motor speed profile (RS(t)) based on the estimated unbalance values and the inertia values; and controlling the electric motor based on the modified sinusoidal motor speed profile (RS(t)).

7. The method according to claim 1, wherein the unbalance value and the inertia value are estimated based at least in part on the motor speed value (AS(t)) and a torque value (AT(t)).

8. A washing machine comprising:

a casing;

a laundry drum mounted inside the casing to rotate about a rotation axis;

an electric motor configured to rotate the laundry drum about the rotation axis; and an electronic control system configured to:

generate a sinusoidal motor speed profile (RS(t));

control the electric motor based on the sinusoidal motor speed profile (RS);

estimate an unbalance value indicative of an unbalance of a load in the laundry drum;

estimate an inertia value indicative of an inertia of the load in the laundry drum;

generate a modified sinusoidal motor speed profile by varying an amplitude of the sinusoidal motor speed profile based on the estimated unbalance value and the inertia value;

control the electric motor based on the modified sinusoidal motor speed profile to thereby redistribute the load in the laundry drum to reduce the unbalance of the load in the laundry drum;

determine a motor speed value (AS(t)) indicative of a motor speed of the electric motor;

estimate a settling speed (TS(t)) based on the inertia value; and one of:

(1) interrupt the generation of the sinusoidal motor speed profile and increase the motor speed to a prefixed high speed of a spin cycle upon determining that:

the estimated unbalance value is lower than a predetermined unbalance threshold, and the motor speed value (AS(t)) is greater than the settling speed (TS(t)); or (2) generate the sinusoidal motor speed profile (RS(t)) a subsequent time and vary the amplitude of the sinusoidal motor speed profile (RS(t)) a subsequent time upon determining that:

the estimated unbalance is lower than the unbalance threshold, and one or both of:

the motor speed value (AS(t)) is lower than the settling speed (TS(t)), and/or a minimum speed value (VA) of the sinusoidal motor speed profile (RS(t)) is lower than the settling speed (TS(t)).

9. The washing machine of claim 8, wherein the electronic control system is further configured to:

interrupt the generation of the sinusoidal motor speed profile and increase the motor speed to the prefixed high speed of the spin cycle upon determining that:

the estimated unbalance value is lower than the predetermined unbalance threshold, the motor speed value (AS(t)) is greater than the settling speed (TS(t)), and a minimum speed value (V1) of the sinusoidal motor speed profile (RS(t)) is greater than the settling speed (TS(t)).

10. The washing machine of claim 8, wherein the electronic control system is further configured to subsequent to controlling the electric motor based on the modified sinusoidal motor speed profile to thereby redistribute the load in the laundry drum to reduce the unbalance of the load in the laundry drum, and upon determining that the estimated unbalance is greater than the unbalance threshold:

generate the sinusoidal motor speed profile (RS(t)) a subsequent time; and vary the amplitude of the sinusoidal motor speed profile (RS(t)) a subsequent time.

11. The washing machine of claim 8, wherein the electronic control system is further configured to:

calculate a maximum speed value (VB) and the minimum speed value (VA) of the sinusoidal motor speed profile based on the unbalance value, the inertia value and the predetermined unbalance threshold; and vary the amplitude of the sinusoidal motor speed profile (RS) is further based on the calculated maximum speed value (VB) and the calculated minimum speed value (VA).

12. The washing machine of claim 11, wherein the maximum speed value (VB) and the minimum speed value (VA) of the sinusoidal motor speed profile (RS(t)) are repeatedly calculated based on a difference between the unbalance and the predetermined unbalance threshold and on the inertia.

13. The washing machine of claim 8, wherein the electronic control system is further configured to repeatedly perform during prefixed intervals (Δti):

estimate the unbalance value;

estimate the inertia value;

estimate the settling speed (TS(t));

vary the amplitude of the sinusoidal motor speed profile (RS(t)) based on the estimated unbalance values and the inertia values; and control the electric motor based on the modified sinusoidal motor speed profile (RS(t)).

14. A method for operating a washing machine comprising a casing, a laundry drum mounted inside the casing to rotate about a rotation axis, and an electric motor configured to rotate the laundry drum about the rotation axis, the method comprising:

generating a sinusoidal motor speed profile (RS(t));

controlling the electric motor based on the sinusoidal motor speed profile;

estimating an unbalance value indicative of an unbalance of a load in the laundry drum;

estimating an inertia value indicative of an inertia of the load in the laundry drum;

generating a modified sinusoidal motor speed profile by varying an amplitude of the sinusoidal motor speed profile based on the estimated unbalance value and the inertia value;

controlling the electric motor based on the modified sinusoidal motor speed profile to thereby redistribute the load in the laundry drum to reduce the unbalance of the load in the laundry drum;

determining a motor speed value (AS(t)) indicative of a motor speed of the electric motor;

estimating a settling speed (TS(t)) based on the inertia value, and generating the sinusoidal motor speed profile (RS(t)) a subsequent time following the modified sinusoidal motor speed profile and varying the amplitude of the sinusoidal motor speed profile (RS(t)) a subsequent time upon determining that:

the estimated unbalance is lower than a predetermined unbalance threshold, and one or both of:

the motor speed value (AS(t)) is lower than the settling speed (TS(t)), or a minimum speed value (VA) of the sinusoidal motor speed profile (RS(t)) is lower than the settling speed (TS(t)).

15. The method according to claim 14, further comprising:

interrupting the generation of sinusoidal motor speed profile and increasing the motor speed to a prefixed high speed of a spin cycle upon determining that:

the estimated unbalance value is lower than the predetermined unbalance threshold, the motor speed value (AS(t)) is greater than the settling speed (TS(t)), and the minimum speed value (V1) of the sinusoidal motor speed profile (RS(t)) is greater than the settling speed (TS(t)).

16. The method according to claim 14, further comprising, subsequent to controlling the electric motor based on the modified sinusoidal motor speed profile to thereby redistribute the load in the laundry drum to reduce the unbalance of the load in the laundry drum, and upon determining that the estimated unbalance is greater than the unbalance threshold:

generating the sinusoidal motor speed profile (RS(t)) a subsequent time; and varying the amplitude of the sinusoidal motor speed profile (RS(t)) a subsequent time.

17. The method according to claim 14, further comprising:

calculating a maximum speed value (VB) and the minimum speed value (VA) of the sinusoidal motor speed profile based on the unbalance value, the inertia value and the predetermined unbalance threshold; and varying the amplitude of the sinusoidal motor speed profile (RS) is further based on the calculated maximum speed value (VB) and the calculated minimum speed value (VA).

18. The method according to claim 17, wherein the maximum speed value (VB) and the minimum speed value (VA) of the sinusoidal motor speed profile (RS(t)) are repeatedly calculated based on a difference between the unbalance and the predetermined unbalance threshold and on the inertia.

19. The method according to claim 14, further comprising of repeatedly performing during prefixed intervals (Δti):

estimating the unbalance value;

estimating the inertia value;

estimating the settling speed (TS(t));

varying the amplitude of the sinusoidal motor speed profile (RS(t)) based on the estimated unbalance values and the inertia values; and controlling the electric motor based on the modified sinusoidal motor speed profile (RS(t)).

20. The method according to claim 14, wherein the unbalance value and the inertia value are estimated based at least in part on the motor speed value (AS(t)) and a torque value (AT(t)).

* * * * *